US006856073B2

(12) United States Patent
Bryant et al.

(10) Patent No.: US 6,856,073 B2
(45) Date of Patent: Feb. 15, 2005

(54) ELECTRO-ACTIVE DEVICE USING RADIAL ELECTRIC FIELD PIEZO-DIAPHRAGM FOR CONTROL OF FLUID MOVEMENT

(75) Inventors: Robert G. Bryant, Lightfoot, VA (US); Dennis C. Working, Norfolk, VA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 186 days.

(21) Appl. No.: 10/390,675

(22) Filed: Mar. 13, 2003

(65) Prior Publication Data

US 2003/0173873 A1 Sep. 18, 2003

Related U.S. Application Data

(60) Provisional application No. 60/365,033, filed on Mar. 15, 2002.

(51) Int. Cl.[7] ..... H01L 41/08

(52) U.S. Cl. ..... 310/324; 310/344; 310/348; 310/365; 310/368; 310/333

(58) Field of Search ..... 310/320, 324, 310/333, 344, 348, 365, 368, 369

(56) References Cited

U.S. PATENT DOCUMENTS

| | | | | |
|---|---|---|---|---|
| 2,540,187 A | | 2/1951 | Cherry, Jr. | 310/358 |
| 2,540,194 A | | 2/1951 | Ellett | 310/331 |
| 2,836,737 A | | 5/1958 | Crownover | 310/331 |
| 2,836,738 A | | 5/1958 | Crownover | 310/331 |
| 2,963,597 A | | 12/1960 | Gerber | 310/318 |
| 2,967,956 A | | 1/1961 | Dranetz et al. | 310/330 |
| 3,114,849 A | * | 12/1963 | Poschenrieder | 310/330 |
| 3,215,078 A | | 11/1965 | Stec | 417/322 |
| 3,457,543 A | | 7/1969 | Akervold et al. | 367/155 |
| 3,510,698 A | | 5/1970 | Massa | 310/335 |
| 3,562,764 A | * | 2/1971 | Fujishima | 310/345 |
| 3,857,049 A | | 12/1974 | Zoltan | 310/328 |
| 4,051,455 A | | 9/1977 | Fowler | 310/337 |
| 4,284,921 A | | 8/1981 | Lemonon et al. | 310/322 |
| 4,379,246 A | | 4/1983 | Guntersdorfer et al. | 310/328 |

(List continued on next page.)

FOREIGN PATENT DOCUMENTS

| | | | | |
|---|---|---|---|---|
| JP | 54-138392 | * | 10/1979 | 310/361 |
| JP | 59-174010 | * | 10/1984 | 310/361 |
| WO | WO 87/07218 A1 | | 12/1987 | B41J/3/04 |

OTHER PUBLICATIONS

Hari Singh Nalwa, "Ferroelectric Polymers; Chemistry, Physics, and Applications," Marcel Dekker, Inc., p. 710–711.

(List continued on next page.)

*Primary Examiner*—Thomas M. Dougherty
(74) *Attorney, Agent, or Firm*—Kurt G. Hammerle

(57) ABSTRACT

A fluid-control electro-active device includes a piezo-diaphragm made from a ferroelectric material sandwiched by first and second electrode patterns configured to introduce an electric field into the ferroelectric material when voltage is applied thereto. The electric field originates at a region of the ferroelectric material between the first and second electrode patterns, and extends radially outward from this region of the ferroelectric material and substantially parallel to the plane of the ferroelectric material. The piezo-diaphragm deflects symmetrically about this region in a direction substantially perpendicular to the electric field. An annular region coupled to and extending radially outward from the piezo-diaphragm perimetrically borders the piezo-diaphragm. A housing is connected to the annular region and defines at least one fluid flow path therethrough with the piezo-diaphragm disposed therein.

41 Claims, 10 Drawing Sheets

U.S. PATENT DOCUMENTS

| | | | | | |
|---|---|---|---|---|---|
| 4,401,911 | A | | 8/1983 | Ravinet et al. | 381/190 |
| 4,409,681 | A | | 10/1983 | White | 367/166 |
| 4,439,706 | A | * | 3/1984 | Matsuoka et al. | 310/353 |
| 4,452,084 | A | | 6/1984 | Taenzer | 310/334 |
| 4,485,325 | A | * | 11/1984 | Yamamoto et al. | 310/344 |
| 4,581,556 | A | | 4/1986 | Yamamoto | 310/366 |
| 4,697,195 | A | | 9/1987 | Quate et al. | 347/46 |
| 4,803,393 | A | | 2/1989 | Takahashi | 310/328 |
| 4,944,659 | A | | 7/1990 | Labbe et al. | 310/26 |
| 5,081,995 | A | | 1/1992 | Lu et al. | 600/459 |
| 5,122,993 | A | | 6/1992 | Hikita et al. | 367/155 |
| 5,262,696 | A | * | 11/1993 | Culp | 310/328 |
| 5,291,090 | A | | 3/1994 | Dias | 310/334 |
| 5,327,041 | A | | 7/1994 | Culp | 310/328 |
| 5,503,034 | A | | 4/1996 | Amano et al. | 73/862.473 |
| 5,592,042 | A | * | 1/1997 | Takuchi et al. | 310/328 |
| 5,631,040 | A | | 5/1997 | Takuchi et al. | 427/100 |
| 5,663,505 | A | | 9/1997 | Nakamura | 73/702 |
| 5,697,195 | A | | 12/1997 | Maylon | 52/344 |
| 5,838,350 | A | | 11/1998 | Newcombe et al. | 347/68 |
| 5,852,337 | A | | 12/1998 | Takeuchi et al. | 310/328 |
| 5,862,275 | A | | 1/1999 | Takeuchi et al. | 385/17 |
| 6,025,671 | A | | 2/2000 | Boecking | 310/369 |
| 6,033,191 | A | | 3/2000 | Kamper et al. | 417/322 |
| 6,042,345 | A | | 3/2000 | Bishop et al. | 417/322 |
| 6,069,433 | A | | 5/2000 | Lazarus et al. | 310/333 |
| 6,071,087 | A | | 6/2000 | Jalink, Jr. et al. | 417/322 |
| 6,071,088 | A | | 6/2000 | Bishop et al. | 417/322 |
| 6,072,267 | A | | 6/2000 | Atsuta | 310/323.06 |
| 6,074,178 | A | | 6/2000 | Bishop et al. | 417/322 |
| 6,091,182 | A | | 7/2000 | Takeuchi et al. | 310/330 |
| 6,106,245 | A | | 8/2000 | Cabuz | 417/322 |
| 6,265,811 | B1 | | 7/2001 | Takeuchi et al. | 310/330 |
| 6,285,116 | B1 | | 9/2001 | Murai et al. | 310/328 |
| 6,297,578 | B1 | * | 10/2001 | Takeuchi et al. | 310/330 |
| 6,323,580 | B1 | | 11/2001 | Bernstein | 310/324 |
| 6,341,732 | B1 | | 1/2002 | Martin et al. | 239/4 |
| 6,351,196 | B1 | | 2/2002 | Nakamura et al. | 333/195 |
| 6,356,007 | B1 | | 3/2002 | Silva | 310/331 |

OTHER PUBLICATIONS

Shinichi Sakai et al, Presented at the 78th Convention of the Audio Engineering Society, "Digital–to–analog Conversion by Piezoelectric Headphone," AES, p. 1–18, ( May 3, 1985).

R.G. Bryant et al, Proceedings, Actuator 2002, Paper A1.3, "Radial Field Piezoelectric Diaphragms," 6 pages, ( June 10, 2002).

R. G. Bryant et al, Presented at The First World Congress on Biomimetics and Artificial Muscles, Albuquerque NM, "The Effect of Radial Electric Fields on Piezoceramics and the Application of these Devices," 6 pages, ( Dec. 9, 2002).

* cited by examiner

ELECTRO-ACTIVE DEVICE USING RADIAL ELECTRIC FIELD PIEZO-DIAPHRAGM FOR CONTROL OF FLUID MOVEMENT

CROSS-REFERENCE TO RELATED PATENT APPLICATIONS

This patent application is co-pending with one related patent application entitled "ELECTRO-ACTIVE TRANSDUCER USING RADIAL ELECTRIC FIELD TO PRODUCE/SENSE OUT-OF-PLANE TRANSDUCER MOTION", Ser. No. 10/347,563, filed Jan. 16, 2003, and owned by the same assignee as this patent application.

ORIGIN OF THE INVENTION

The invention described herein was made by employees of the United States Government and may be manufactured and used by or for the Government for governmental purposes without the payment of any royalties thereon or therefor. Pursuant to 35 U.S.C. § 119, the benefit of priority from provisional application No. 60/365,033, with a filing date of Mar. 15, 2002, is claimed for this non-provisional application.

BACKGROUND OF THE INVENTION

1. Field of the Invention

This invention relates to fluid movement using electro-active devices. More specifically, the invention is an electro-active device that controls fluid movement by means of a piezo-diaphragm that undergoes out-of-plane deflection when a radial electric field is induced in the plane of the piezo-diaphragm.

2. Description of the Related Art

Piezo pumps and valves made from active piezo-elements require the mounting of these piezo-elements to hold them in place for directed mechanical action and electrical contact. In general, the mounting affects the performance of the device because it becomes an integral part of the piezo-element. More specifically, the mounting influences the piezo-element by restricting its movement and changing the mechanical resonance frequency and response of the piezo-element. Additionally, the mounting fixture and any additional mechanical elements are subjected to mechanical fatigue as the piezo-element vibrates and exerts mechanical strain on the fixture.

SUMMARY OF THE INVENTION

In accordance with the present invention, an electro-active device is provided for the control of fluid movement. A ferroelectric material defines a first surface and a second surface opposing the first surface. The first surface and second surface lie in substantially parallel planes. A first electrode pattern is coupled to a portion of the first surface to define a first side of a piezo-diaphragm. A second electrode pattern is coupled to a portion of the second surface to define a second side of the piezo-diaphragm. The first and second electrode patterns are configured to introduce an electric field into the ferroelectric material when the first and second electrode patterns have voltage applied thereto. The electric field originates at a region of the ferroelectric material between the first and second electrode patterns, and extends radially outward from this region and substantially parallel to the first and second surfaces of the ferroelectric material. The piezo-diaphragm correspondingly deflects symmetrically about this region in the ferroelectric material in a direction substantially perpendicular to the electric field.

An annular region is coupled to and extends radially outward from the piezo-diaphragm. That is, the annular region circumferentially surrounds the piezo-diaphragm. A housing is connected to the annular region and defines at least one fluid flow path therethrough with the piezo-diaphragm disposed therein.

DETAILED DESCRIPTION OF THE INVENTION

Figure 1:
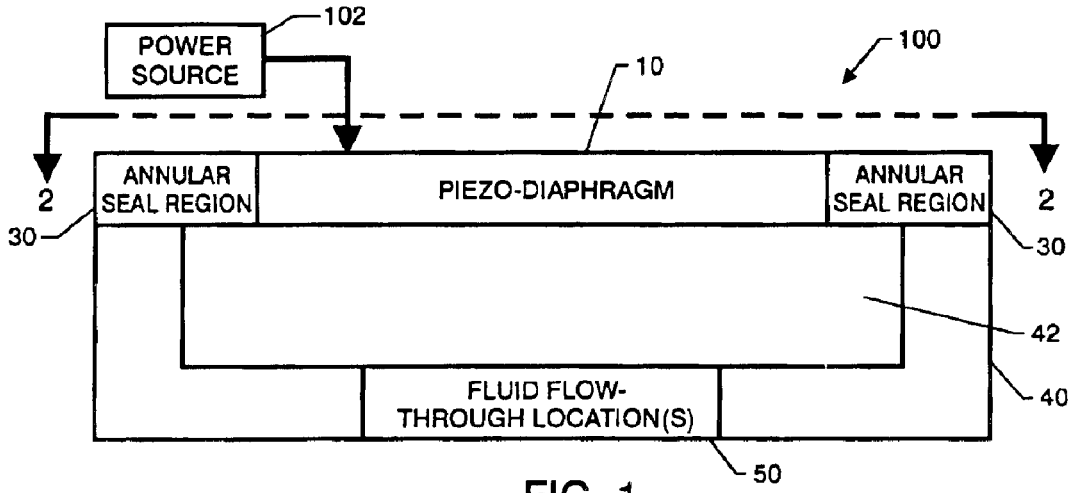
FIG. 1 is a schematic side view of a single-stage embodiment of an electro-active device for controlling the movement of fluid in accordance with the present invention.
Figures 2A, 2B, 2C, 2D:
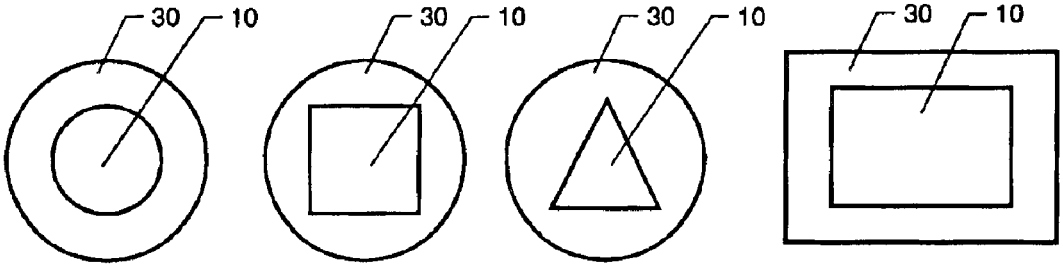
FIG. 2A is a plan view taken along line 2—2 in FIG. 1 illustrating one embodiment of the present invention having circular piezo-diaphragm and circular annular seal region.
FIG. 2B is a plan view taken along line 2—2 in FIG. 1 illustrating another embodiment of the present invention having a rectangular piezo-diaphragm and circular annular seal region.
FIG. 2C is a plan view taken along line 2—2 in FIG. 1 illustrating still another embodiment of the present invention having triangular piezo-diaphragm and circular annular seal region.
FIG. 2D is a plan view taken along line 2—2 in FIG. 1 illustrating yet another embodiment of the present invention having a rectangular piezo-diaphragm and a rectangular annular seal region.

Referring now to the drawings, and more particularly to FIG. 1, a top-level schematic drawing of one embodiment of an electro-active device for the control of fluid movement in accordance with the present invention is shown and referenced generally by numeral 100. Depending on its particular configuration, electro-active device 100 can function as a valve or a pump. However, in each case, the work-performing structure thereof will be the same. More specifically, electro-active device 100 has a piezo-diaphragm 10 surrounded circumferentially by an annular seal region 30 coupled to piezo-diaphragm 10, a housing 40 connected to annular seal region 30, and one or more fluid flow-through locations 50 provided in or defined by housing 40. The circumferential shapes of piezo-diaphragm 10 and annular seal region 30 can be tailored to suit a particular application. Further, piezo-diaphragm 10 and annular seal region 30 can have their circumferential shapes correspond with one another or be different from one another. Several examples of possible geometries are illustrated in FIGS. 2A–2D. Examples of correspondence between the geometries of the piezo-diaphragm 10 and the annular seal region 30 are illustrated in FIGS. 2A and 2D, whereas examples of differences therebetween are illustrated in FIGS. 2B and 2C.

Housing 40 along with fluid flow-through locations 50 combine to define a fluid flow path in which piezo-diaphragm 10 is disposed. That is, housing 40 typically defines one or more cavities (e.g., one is shown in FIG. 1) 42 adjacent piezo-diaphragm 10 and in fluid communication with fluid flow-through location(s) 50. If device 100 is to operate as a pump, piezo-diaphragm 10 is energized to deflect in an out-of-plane fashion in order to move fluid through location(s) 50 which can be realized by opening(s) or valve(s), where each such valve could be an active or passive valve. If device 100 is to operate as a valve, piezo-diaphragm 10 is deflected in an out-of-plane fashion to either seal against location(s) 50 (to close the valve) or move away from location(s) 50 as shown (to open the valve). In either case, such deflection of piezo-diaphragm 10 is brought about by the application of electric power thereto. Accordingly, a power source 102 will be electrically coupled to piezo-diaphragm 10.

Figure 3:
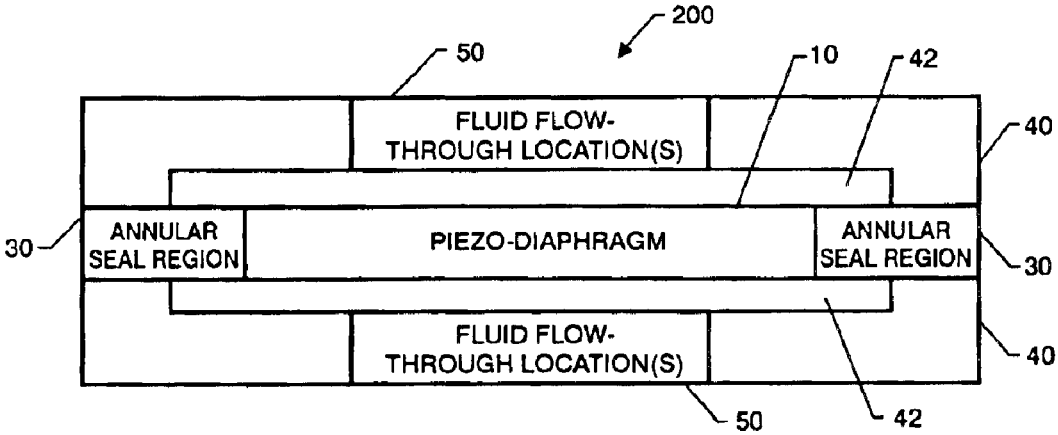
FIG. 3 is a schematic side view of a dual-stage embodiment of the present invention.

As just described, device 100 acts as a single stage device. However, the present invention is not so limited. For example, FIG. 3 illustrates a two-stage electro-active device 200 where like reference numerals are used to describe common elements previously described herein. In two-stage device 200, housing 40/location(s) 50 define fluid flow paths on either side of piezo-diaphragm 10 such that deflection of piezo-diaphragm 10 results in fluid compression in one of cavities 42 and simultaneous fluid expansion in the other of cavities 42.

Figure 4:
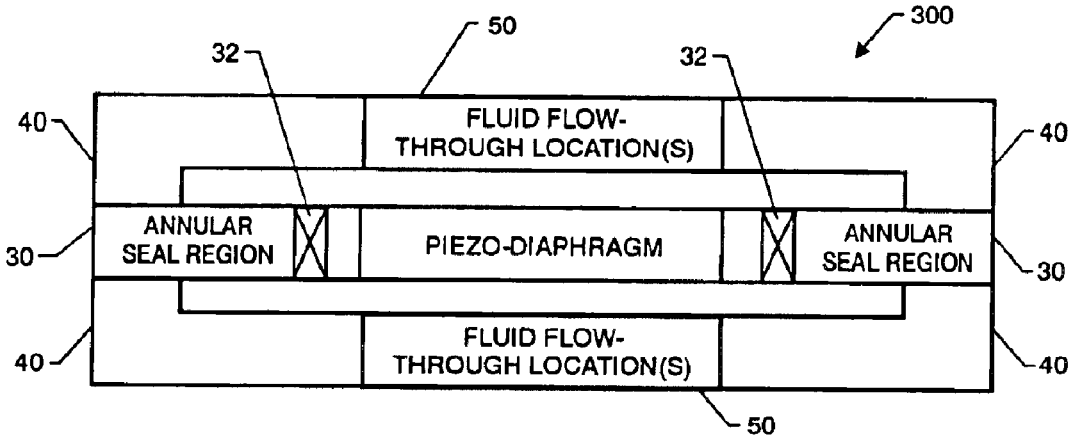
FIG. 4 is a schematic side view of a dual-stage embodiment that provides for fluid movement between the stages thereof.

Another embodiment of the present invention is illustrated in FIG. 4 where electro-active device 300 further includes one or more valves 32 integrated into annular seal region 30. In this way, the fluid flow paths on either side of piezo-diaphragm 10 can be coupled to one another within device 300. Such valving could be used for pressure relief, fluid overflow, and/or hydrostatic compensation depending on the particular application.

Figure 5:
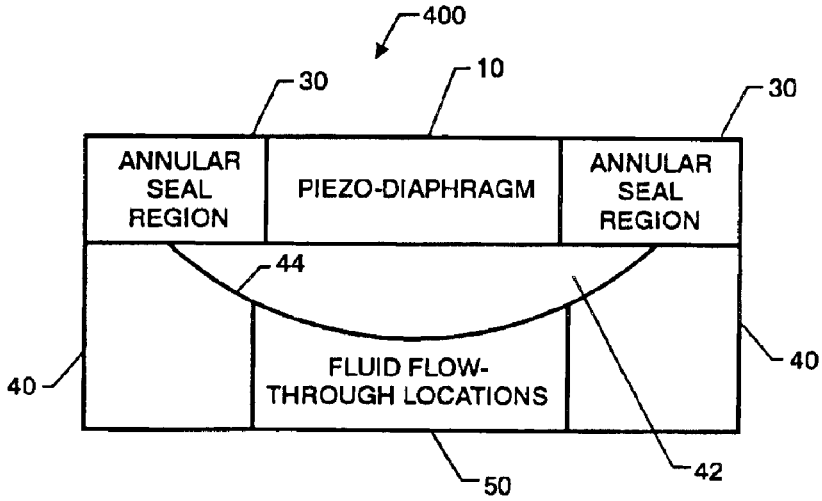
FIG. 5 is a schematic side view of another embodiment of the present invention in which the wall of the cavity adjacent the piezo-diaphragm is contoured to correspond to the deflected shape of the piezo-diaphragm.
Figure 6:
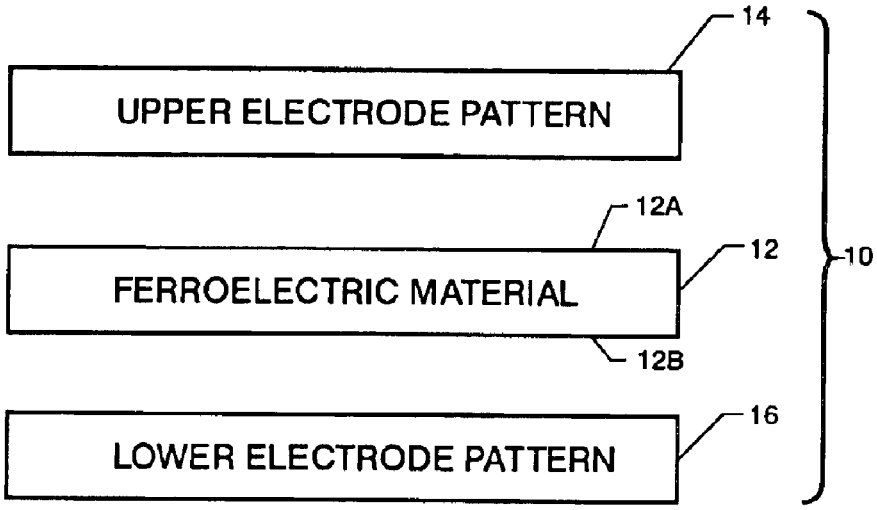
FIG. 6 is a schematic view of a piezo-diaphragm according to the present invention.

Still further, housing 40 can be configured as an electro-active device 400 shown in FIG. 5. That is, housing 40 can have interior wall 44 (defining cavity 42) contoured to correspond to the shape of the deflection of piezo-diaphragm 10. If device 400 is operated as a valve with location(s) 50 defined by simple opening(s) in housing 40, contouring of wall 44 will provide a good valve seat when piezo-diaphragm 10 is deflected thereagainst. If device 400 is to be used as a pump, contouring of wall 44 could provide, for example, fluid flow through cavity 42 or mixing of fluid in cavity 42.

The common features between each of the above-described fluid control devices are that piezo-diaphragm 10 has annular seal region 30 mechanically coupled thereto and that housing 40 is connected to region 30. In these embodiments, the out-of-plane deflection experienced by piezo-diaphragm 10 is not constrained by housing 40 and does not mechanically strain housing 40. Thus, all mechanical work produced by piezo-diaphragm 10 can be applied to the control of fluid movements into, out of, and/or through housing 40.

The construction of piezo-diaphragm 10 is described in the cross-referenced U.S. patent application Ser. No. 10/347,563, the contents of which are hereby incorporated by reference. For a complete understanding of the present invention, the description of piezo-diaphragm 10 will be repeated herein. The essential elements of piezo-diaphragm 10 are a ferroelectric material 12 sandwiched between an upper electrode pattern 14 and a lower electrode pattern 16. More specifically, electrode patterns 14 and 16 are coupled to ferroelectric material 12 such that voltage applied to the electrode patterns is coupled to ferroelectric material 12 to generate an electric field as will be explained further below. Such coupling to ferroelectric material 12 can be achieved in any of a variety of well known ways. For example, electrode patterns 14 and 16 could be applied directly to opposing surfaces of ferroelectric material 12 by means of vapor deposition, printing, plating, or gluing, the choice of which is not a limitation of the present invention.

Ferroelectric material 12 is any piezoelectric, piezorestrictive, electrostrictive (such as lead magnesium niobate lead titanate (PMN-PT)), pyroelectric, etc., material structure that deforms when exposed to an electrical field (or generates an electrical field in response to deformation as in the case of an electro-active sensor). One class of ferroelectric materials that has performed well in tests of the present invention is a ceramic piezoelectric material known as lead zirconate titanate, which has sufficient stiffness such that piezo-diaphragm 10 maintains a symmetric, out-of-plane displacement as will be described further below.

Figure 7:
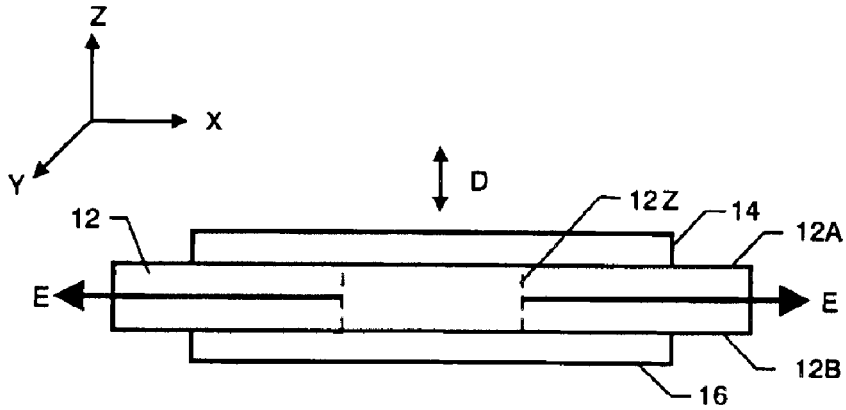
FIG. 7 is a side, schematic view of the piezo-diaphragm shown in FIG. 6 illustrating the radial electric field and out-of-plane displacement generated thereby.
Figure 8:
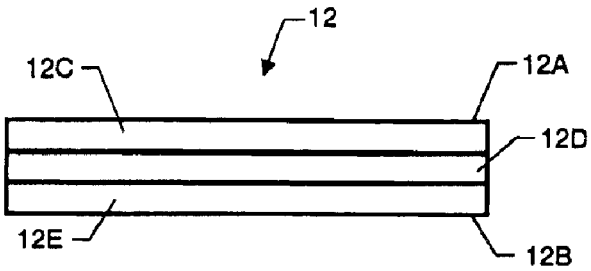
FIG. 8 is a side view of a layered construction of the piezo-diaphragm's ferroelectric material.
Figure 9:
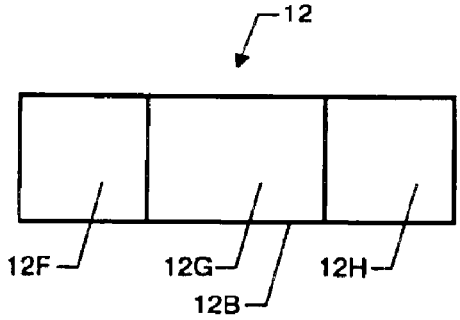
FIG. 9 is a side view of a piece-wise construction of the piezo-diaphragm's ferroelectric material.

Ferroelectric material 12 is typically a composite material where the term "composite" as used herein can mean one or more materials mixed together (with at least one of the materials being ferroelectric) and formed as a single sheet or monolithic slab with major opposing surfaces 12A and 12B lying in substantially parallel planes as best illustrated in the side view shown in FIG. 7. However, the term "composite" as used herein is also indicative of: i) a ferroelectric laminate made of multiple ferroelectric material layers such as layers 12C, 12D, 12E (FIG. 8) or ii) multiple ferroelectric pieces bonded together such as pieces 12F, 12G, 12H (FIG. 9). Note that in each case, major opposing surfaces 12A and 12B are defined for ferroelectric material 12.

In general, upper electrode pattern 14 is aligned with lower electrode pattern 16 such that, when voltages are applied thereto, a radial electric field E is generated in ferroelectric material 12 in a plane that is substantially parallel to the parallel planes defined by surfaces 12A and 12B, i.e., in the X-Y plane. More specifically, electrode patterns 14 and 16 are aligned on either side of ferroelectric material 12 such that the electric field E originates and extends radially outward in the X-Y plane from a region 12Z of ferroelectric material 12. The size and shape of region 12Z is determined by electrode patterns 14 and 16, a variety of which will be described further below.

The symmetric, radially-distributed electric field E mechanically strains ferroelectric material 12 along the Z-axis (perpendicular to the applied electric field E). This result is surprising and contrary to related art electro-active transducer or piezo-diaphragm teachings and devices. That is, it has been well-accepted in the transducer art that out-of-plane (i.e., Z-axis) displacement required an asymmetric electric field through the thickness of the active material. The asymmetric electric field introduces a global asymmetrical strain gradient in the material that, upon electrode polarity reversal, counters the inherent induced polarity through only part of the active material to create an in-situ bimorph. This result had been achieved by having electrodes on one side of the ferroelectric material. However, tests of the present invention have shown that displacement is substantially increased by using electrode patterns 14 and 16 that are aligned on both sides of ferroelectric material 12 such that the symmetric electric field E originates and extends both radially outward from region 12Z and throughout the thickness of the ferroelectric material.

Figure 10:
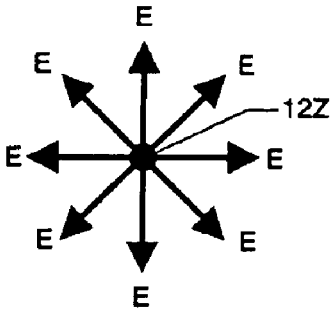
FIG. 10 is a diagrammatic view of a radial electric field originating from a point in the X-Y plane of the piezo-diaphragm's ferroelectric material.
Figure 11:
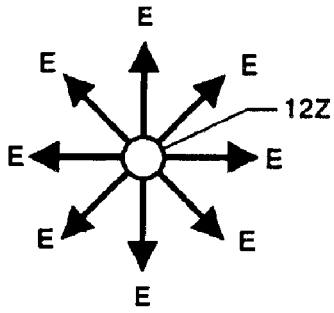
FIG. 11 is a diagrammatic view of a radial electric field originating from the periphery of a circle in the X-Y plane of the piezo-diaphragm's ferroelectric material.
Figure 12:
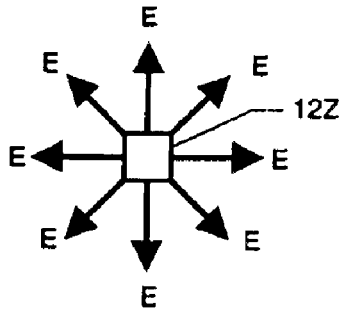
FIG. 12 is a diagrammatic view of a radial electric field originating from the periphery of a square in the X-Y plane of the piezo-diaphragm's ferroelectric material.

Electrode patterns 14 and 16 can define a variety of shapes (i.e., viewed across the X-Y plane) of region 12Z without departing from the scope of the present invention. For example, as shown in FIG. 10, region 12Z could be a point with radial electric field E extending radially outward therefrom. The periphery of region 12Z could also be a circle (FIG. 11) or a rectangle (FIG. 12) with radial electric field E extending radially outward therefrom. Other X-Y plane shapes (e.g., triangles, pentagons, hexagons, etc.) of region 12Z could also be defined without departing from the scope of the present invention.

In accordance with the present invention, radially-extending electric field E lies in the X-Y plane while displacement D occurs in the Z direction substantially perpendicular to surfaces 12A and 12B. Depending on how electric field E is applied, displacement D can be up or down along either the positive or negative Z-axis, but does not typically cross the X-Y plane for a given electric field. The amount of displacement D is greatest at the periphery of region 12Z where radial electric field E originates. The amount of displacement D decreases with radial distance from region 12Z with deflection of ferroelectric material 12 being symmetric about region 12Z. That is, ferroelectric material 12 deflects in a radially symmetric fashion and in a direction that is substantially perpendicular to surfaces 12A and 12B.

As mentioned above, a variety of electrode patterns can be used to achieve the out-of-plane or Z-axis displacement in the present invention. A variety of non-limiting electrode patterns and resulting local electric fields generated thereby will now be described with the aid of FIGS. 13–20 where the "A" figure depicts an upper electrode pattern 14 as viewed from above, the "B" figure depicts the corresponding lower electrode pattern 16 as viewed from below, and the "C" figure is a cross-sectional view of the ferroelectric material with the upper and lower electrode patterns coupled thereto and further depicts the resulting local electric fields generated by application of a voltage to the particular electrode patterns.

Figure 13A:
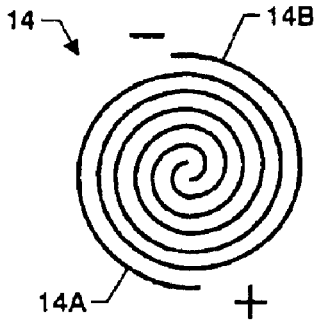
FIG. 13A is an isolated view of an upper electrode pattern using circular intercirculating electrodes.
Figure 13B:
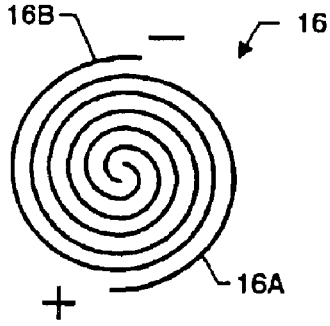
FIG. 13B is an isolated view of a lower electrode pattern using circular intercirculating electrodes.
Figure 13C:
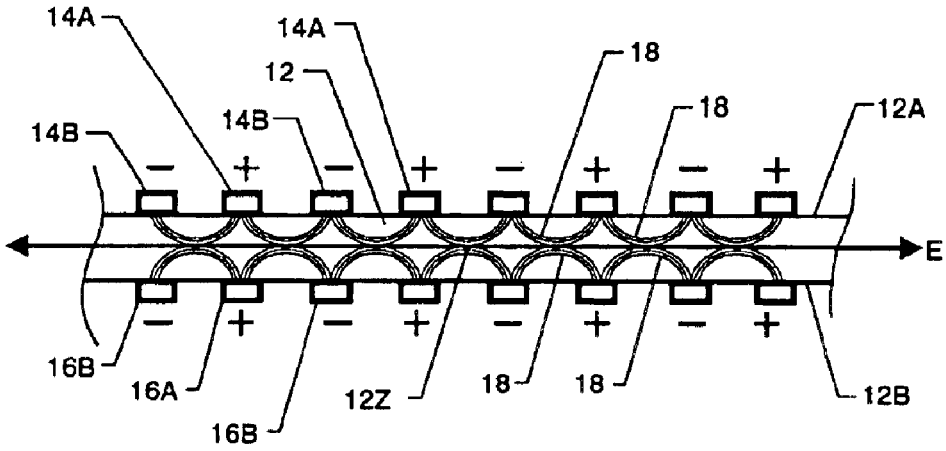
FIG. 13C is a cross-sectional view of a portion of the piezo-diaphragm having the upper and lower electrode patterns depicted in FIGS. 13A and 13B.

In FIGS. 13A–13C, upper electrode pattern 14 and lower electrode pattern 16 comprise intercirculating electrodes with electrodes 14A and 16A connected to one polarity and electrodes 14B and 16B connected to an opposing polarity. For illustrative purposes, electrodes 14A and 16A have a positive polarity applied thereto and electrodes 14B and 16B have a negative polarity applied thereto.

Patterns 14 and 16 are aligned such that they are a mirror image of one another as illustrated in FIG. 13C. The resulting local electric field lines are indicated by arced lines 18. In this example, the radial electric field E originates from a very small diameter region 12Z which is similar to the electric field illustrated in FIG. 10.

Figures 14A, 14B:
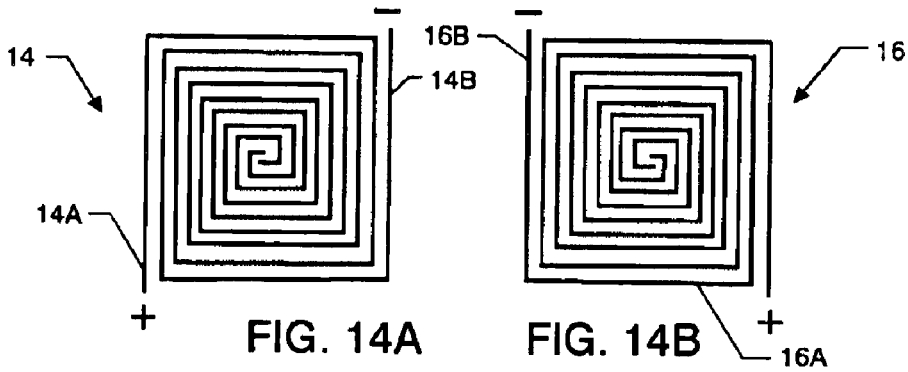
FIG. 14A is an isolated view of an upper electrode pattern using square intercirculating electrodes.
FIG. 14B is an isolated view of a lower electrode pattern using square intercirculating electrodes.
Figure 14C:
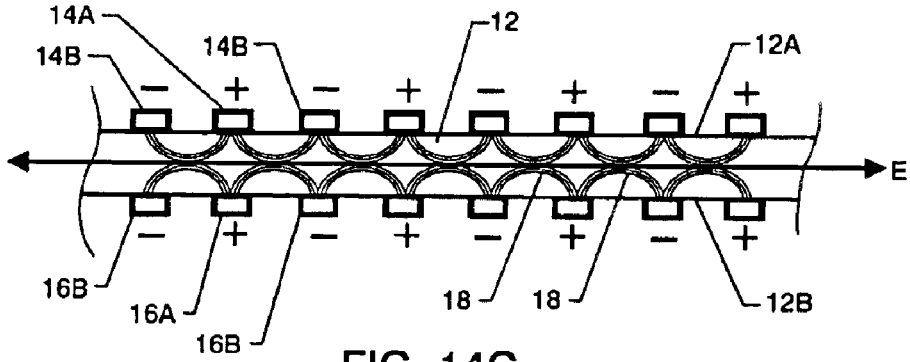
FIG. 14C is a cross-sectional view of a portion of the piezo-diaphragm having the upper and lower electrode patterns depicted in FIGS. 14A and 14B.

The spiraling intercirculating electrode pattern need not be based on a circle. For example, the intercirculating electrodes could be based on a square as illustrated in FIGS. 14A–14C. Other geometric intercirculating shapes (e.g., triangles, rectangles, pentagons, etc.) could also be used without departing from the scope of the present invention.

Figures 15A, 15B:
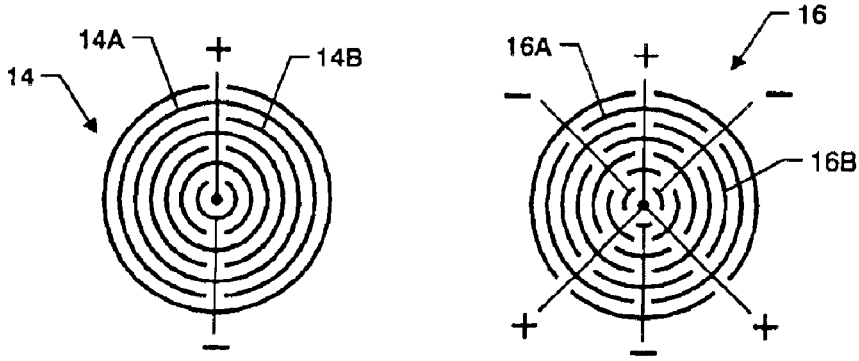
FIG. 15A is an isolated view of an upper electrode pattern using circular interdigitated ring electrodes.
FIG. 15B is an isolated view of a lower electrode pattern using circular interdigitated ring electrodes.
Figure 15C:
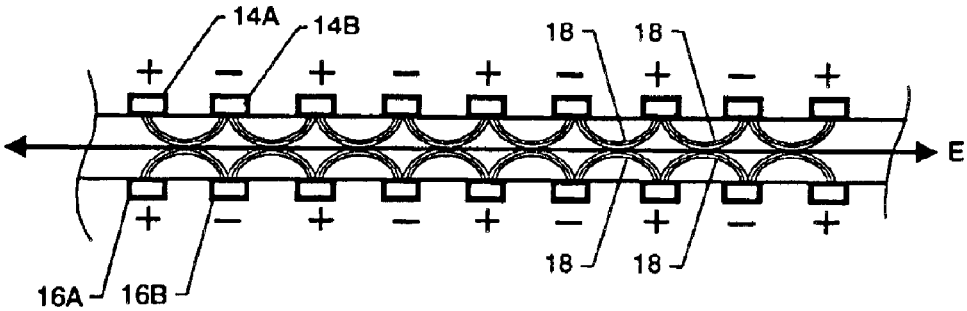
FIG. 15C is a cross-sectional view of a portion of the piezo-diaphragm having the upper and lower electrode patterns depicted in FIGS. 15A and 15B.
Figure 16A:
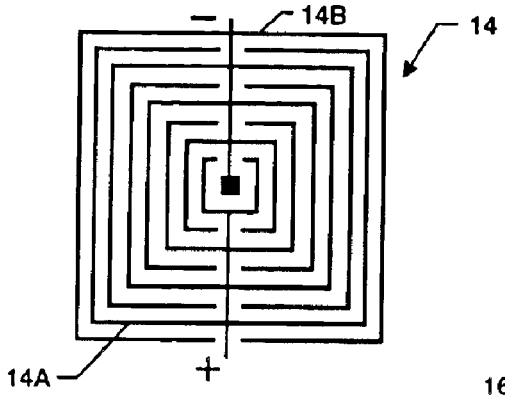
FIG. 16A is an isolated view of an upper electrode pattern using square interdigitated ring electrodes.
Figure 16B:
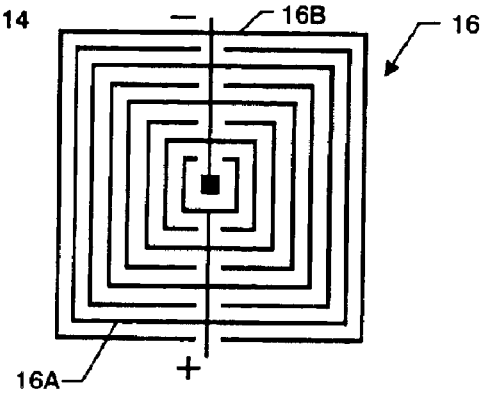
FIG. 16B is an isolated view of a lower electrode pattern using square interdigitated ring electrodes.
Figure 16C:
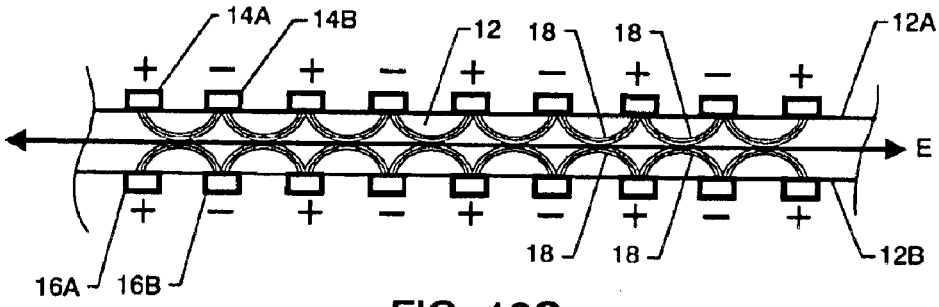
FIG. 16C is a cross-sectional view of a portion of the piezo-diaphragm having the upper and lower electrode patterns depicted in FIGS. 16A and 16B.

The electrode patterns may also be fabricated as interdigitated rings. For example, FIGS. 15A–15C depict circular-based interdigitated ring electrode patterns where upper and lower electrode patterns 14 and 16 are positioned to be aligned with one another in the Z-axis so that their polarities are aligned as shown in FIG. 15C. Once again, the interdigitated ring electrode patterns could be based on geometric shapes other than a circle. Accordingly, FIGS. 16A–16C depict square-based interdigitated ring electrode patterns as an example of another suitable geometric shape.

Figure 17A:
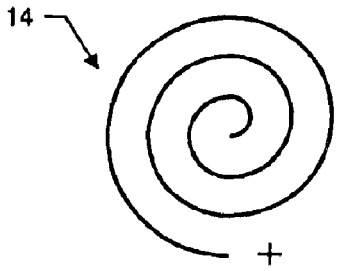
FIG. 17A is an isolated view of an upper electrode pattern using a spiraling electrode.
Figure 17B:
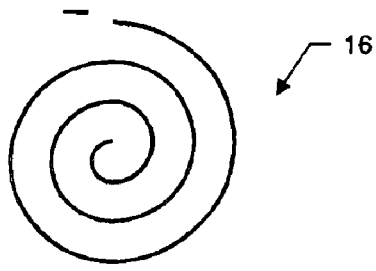
FIG. 17B is an isolated view of a lower electrode pattern using a spiraling electrode.
Figure 17C:
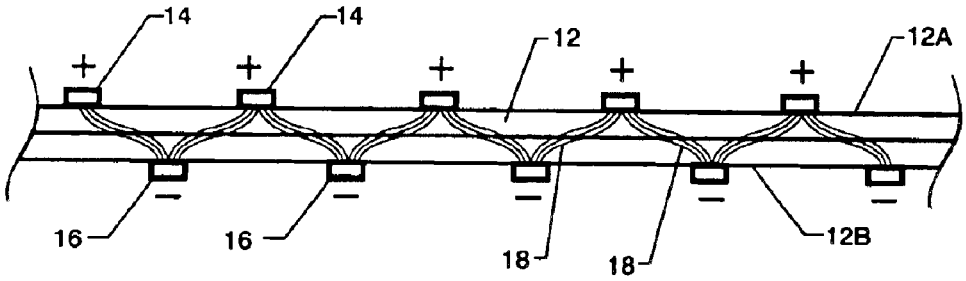
FIG. 17C is a cross-sectional view of a portion of the piezo-diaphragm having the upper and lower electrode patterns depicted in FIGS. 17A and 17B.
Figure 18A:
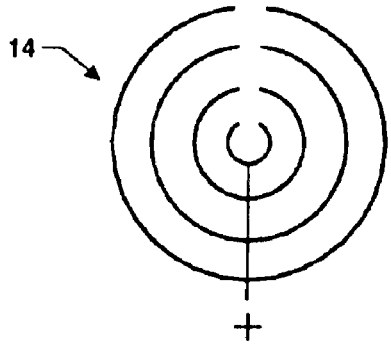
FIG. 18A is an isolated view of an upper electrode pattern using concentric ring electrodes.
Figure 18B:
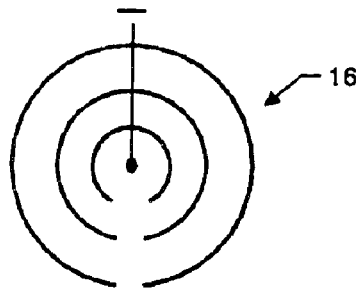
FIG. 18B is an isolated view of a lower electrode pattern using concentric ring electrodes.
Figure 18C:
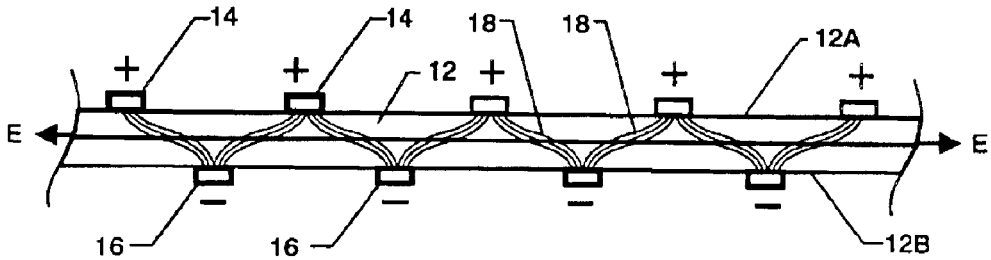
FIG. 18C is a cross-sectional view of a portion of the piezo-diaphragm having the upper and lower electrode patterns depicted in FIGS. 18A and 18B.

The upper and lower electrode patterns are not limited to mirror image or other aligned patterns. For example, FIGS. 17A–17C depict the use of spiraling electrodes in which upper and lower electrode patterns are staggered with respect to one another when viewed in the cross-section shown in FIG. 17C. Each electrode pattern is defined by a single polarity electrode pattern so that local electric field 18 extends between surfaces 12A and 12B of ferroelectric material 12. Note that the resulting staggered or cross pattern could be achieved by other electrode patterns such as the ring-based electrode patterns illustrated in FIGS. 18A–18C.

For applications requiring greater amounts of out-of-plane displacement D, the electrode patterns can be designed such that the induced radial electric field E enhances the localized strain field of the piezo-diaphragm. In general, this enhanced strain field is accomplished by providing an electrode pattern that complements the mechanical strain field of the piezo-diaphragm. One way of accomplishing this result is to provide a shaped piece of electrode material at the central portion of each upper and lower electrode pattern, with the shaped pieces of electrode materials having opposite polarity voltages applied thereto. The local electric field between the shaped electrode materials is perpendicular to the surfaces of the ferroelectric material, while the remainder of the upper and lower electrode patterns are designed so that the radial electric field originates from the aligned edges of the opposing-polarity shaped electrode materials.

Figures 19A, 19B:
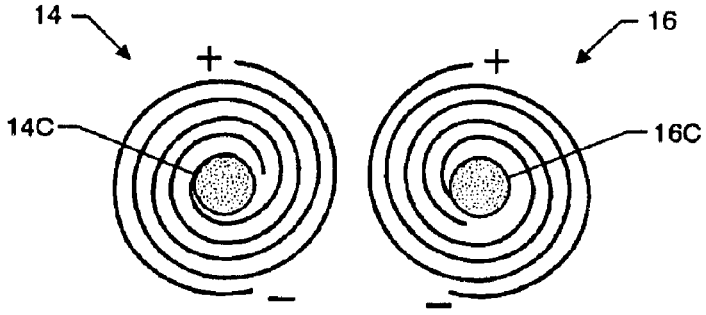
FIG. 19A is an isolated view of another upper electrode pattern based on intercirculating electrodes.
FIG. 19B is an isolated view of another lower electrode pattern based on intercirculating electrodes.
Figure 19C:
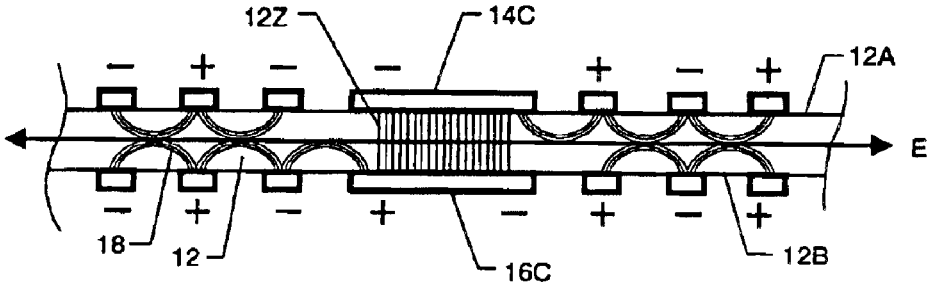
FIG. 19C is a cross-sectional view of a portion of the piezo-diaphragm having the upper and lower electrode patterns depicted in FIGS. 19A and 19B.

For example, FIGS. 19A–19C depict spiral-based intercirculating electrode patterns in which a shaped negative electrode 14C is aligned over a shaped positive electrode 16C at the center portions of upper electrode pattern 14 and lower electrode pattern 16. Under this embodiment, a circularly shaped region 12Z (aligned with the perimeters of electrodes 14C and 16C) is defined in ferroelectric material 12 with the radial electric field E extending radially outward therefrom. Note that such strain field enhancement is not limited to circularly-shaped electrodes 14C and 16C, as these shapes could be triangular, square, hexagonal, etc. Further, the remaining portions of the electrode patterns could be based on the above-described interdigitated ring or cross-pattern (staggered) electrode patterns.

Figure 20A:
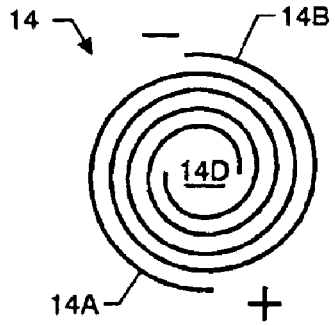
FIG. 20A is an isolated view of another embodiment of an electrode pattern based on intercirculating electrodes.
Figure 20B:
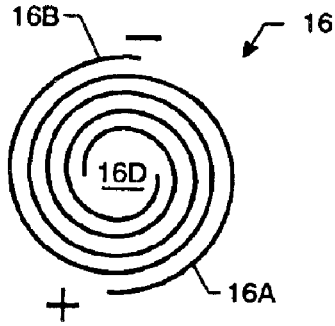
FIG. 20B is an isolated view of another embodiment of an electrode pattern based on intercirculating electrodes.
Figure 20C:
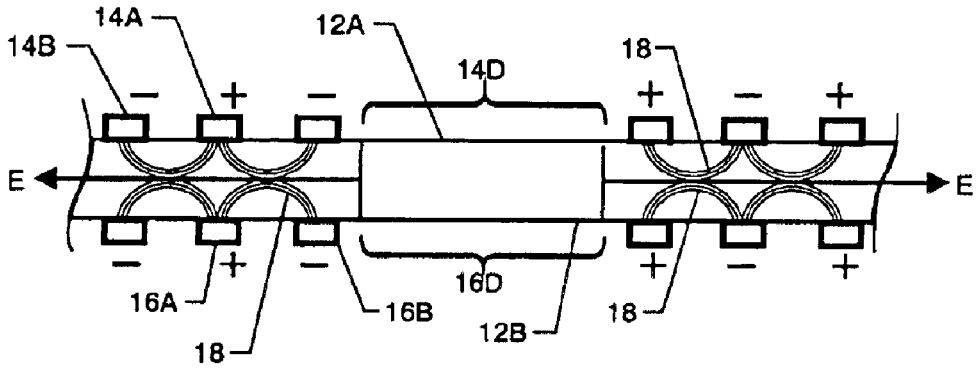
FIG. 20C is a cross-sectional view of a portion of the piezo-diaphragm having the upper and lower electrode patterns depicted in FIGS. 20A and 20B.

Enhancement of the piezo-diaphragm's local strain field could also be achieved by providing an electrode void or "hole" at the center portion of the electrode pattern so that the radial electric field essentially starts from a periphery defined by the start of the local electric fields. For example, FIGS. 20A–20C depict spiral-based intercirculating electrode patterns that define centrally-positioned upper and lower areas 14D and 16D, respectively, that are void of any electrodes. As a result, the induced radial electric field E originates at the points at which local electric field 18 begins, i.e., about the perimeter of aligned areas 14D and 16D. Once again, the central electrode void areas 14D and 16D are not limited to circular shapes, and the electrode patterns could be based on the above-described interdigitated ring or cross-pattern electrode patterns.

Figure 21:
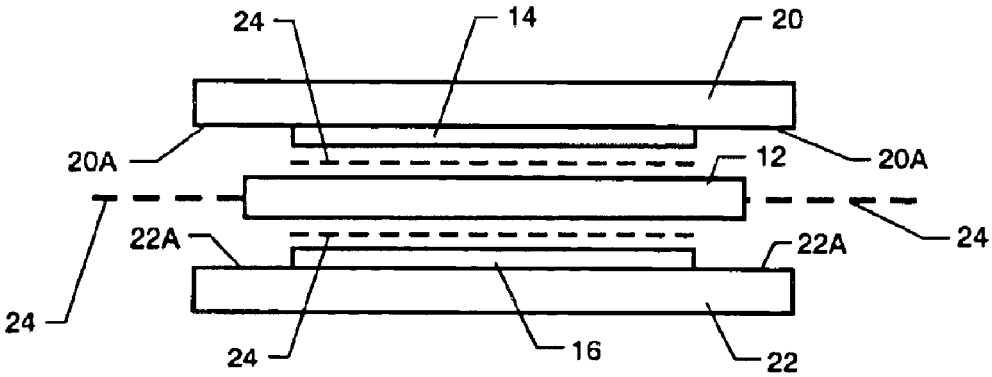
FIG. 21 is an exploded view of an piezo-diaphragm of the present invention encased in a dielectric material package.
Figure 22:
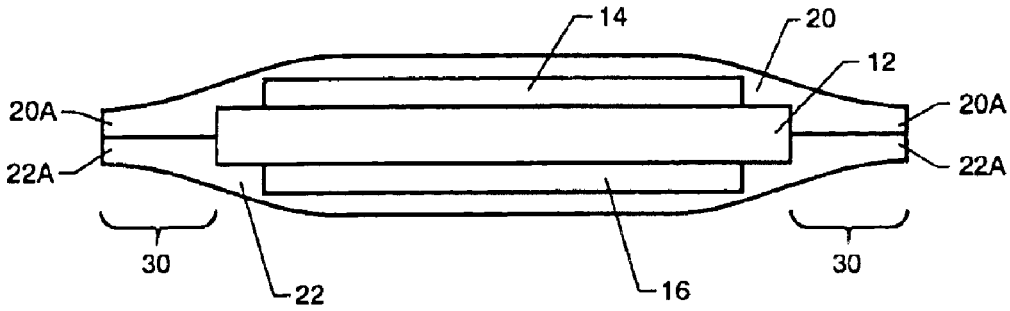
FIG. 22 is a side view of the piezo-diaphragm of FIG. 21 after construction thereof has been completed.

Regardless of the type of electrode pattern, construction of the piezo-diaphragm can be accomplished in a variety of ways. For example, the electrode patterns could be applied directly onto the ferroelectric material. Further, the piezo-diaphragm could be encased in a dielectric material to form annular seal region 30 as well as waterproof or otherwise protect the piezo-diaphragm from environmental effects. By way of non-limiting example, one simple and inexpensive construction is shown in an exploded view in FIG. 21. Upper electrode pattern 14 is etched, printed, plated, or otherwise attached to a film 20 of a dielectric material. Lower electrode pattern 16 is similarly attached to a film 22 of the dielectric material. Films 20 and 22 with their respective electrode patterns are coupled to ferroelectric material 12 using a non-conductive adhesive referenced by dashed lines 24. Each of films 20 and 22 is larger than ferroelectric material 12 so that film portions 20A and 22A that extend beyond the perimeter of ferroelectric material 12 can be joined together using non-conductive adhesive 24. When the structure illustrated in FIG. 21 is pressed together, piezo-diaphragm 10 is encased in dielectric material 20/22 with portions 20A/22A forming annular seal region 30 as illustrated in FIG. 22 (with the non-conductive adhesive being omitted for clarity of illustration).

Figure 23:
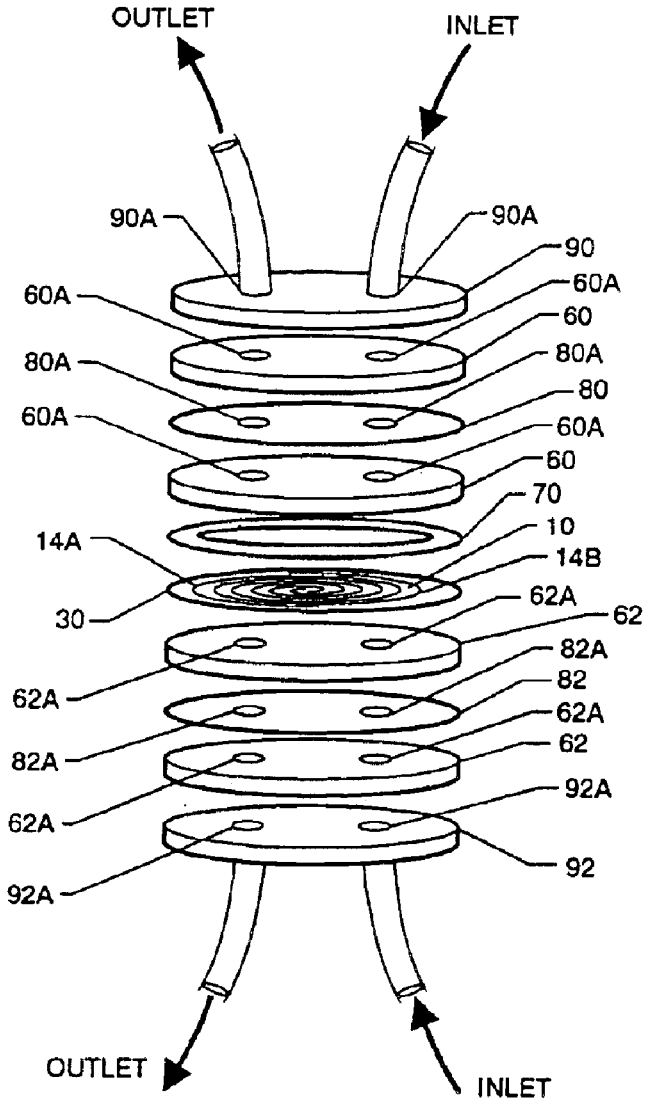
FIG. 23 is an exploded, perspective view of a two-stage device in which the housing and fluid flow-through locations are defined by a stacked arrangement of plates.

Referring again to FIGS. 1 and 3–5, housing 40 and fluid flow-through location(s) 50 can be constructed in a variety of ways without departing from the scope of the present invention. For example, a two-stage device could be realized as shown in FIG. 23 where a stacked arrangement of layers or plates defines both the housing and fluid flow-through locations. More specifically, annular seal region 30 is captured between upper and lower valve guide plates 60 and 62, respectively. If needed, spacer washers/gaskets 70 (e.g., only one is shown) can be provided between the plates and/or annular seal region 30. As described above, piezo-diaphragm 10 (illustrated by intercirculating electrodes 14A and 14B) is coupled to annular seal region 30. An upper flapper valve plate 80 having flapper valves 80A incorporated therein is captured between upper valve guide plates 60. Similarly, a lower flapper valve plate 82 having flapper valves 82A incorporated therein is captured between lower valve guide plates 62. Holes 60A provided in upper valve guide plates 60 are sized/placed to permit one way opening of flapper valves 80A. Similarly, holes 62A provided in lower valve guide plates 62 are sized/placed to permit one way opening of flapper valves 82A. Upper and lower manifold plates 90 and 92, respectively, can be used at either end of the assembly with respective holes 90A and 92A defining the appropriate fluid inlets and outlets of the device.

Figure 24:
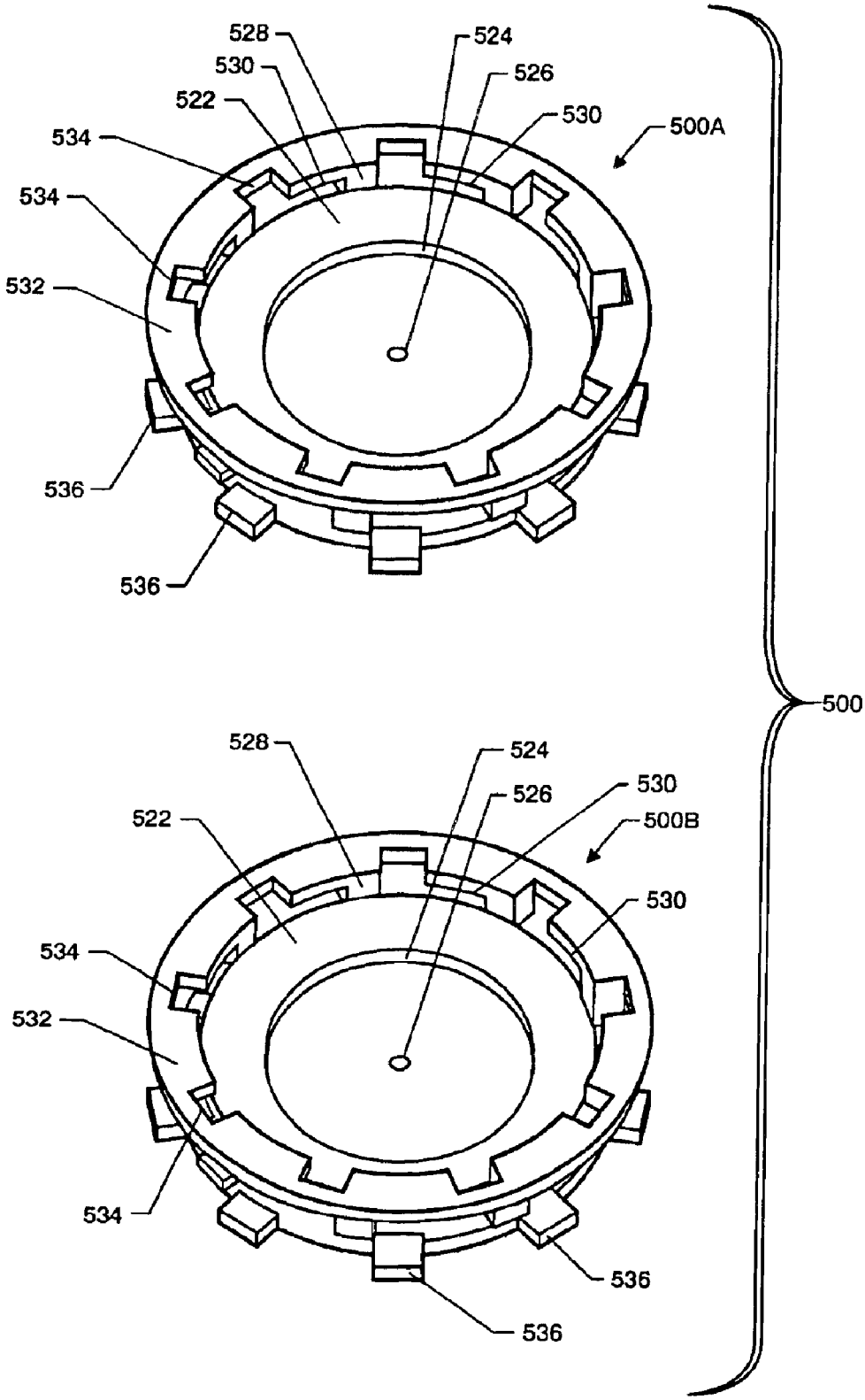
FIG. 24 is a perspective view of an unassembled two-piece housing in accordance with the present invention.

The present invention's housing and fluid flow-through locations could also be realized by means of a two-piece housing designed to simultaneously capture and seal a piezo-diaphragm and annular seal region therein upon assembly. One such two-piece housing assembly is illustrated in FIG. 24 and referenced generally by numeral 500. Two-piece housing 500 consists of identical upper and lower housings 500A and 500B respectively. Each of housings 500A and 500B has: a circular sealing ring 522 on which a (circular) annular sealing region (not shown in FIG. 24) can rest; a recessed portion 524 defining a cavity over which a (circular) piezo-diaphragm (not shown) will reside (note that the underside of each housing could also be recessed); a hole 526 formed in recessed portion 524 through which fluid can flow; an annular interlock ring 528 coupled to or integral with the perimeter of sealing ring 522 with a plurality of interlock slots 530 cut therein; a tab alignment ring 532 coupled to or integral with interlock ring 528 with a plurality of tab alignment grooves 534 formed therein; and a plurality of tabs 536 extending radially outward from sealing ring 522, where tabs 536 are sized to fit into alignment grooves 534 and slide into interlock slots 530.

In use of housing assembly 500, a circular piezo-diaphragm with circular annular seal region coupled thereto (not shown) is placed in lower housing 500B such that the annular seal region 30 rests on sealing ring 522. Tabs 536 on upper housing 500A are then aligned with alignment grooves 534 on lower housing 500B and the upper and lower housing are pressed together thereby capturing the annular seal region 30 between the underside of sealing ring 522 of upper housing 500A and the topside of sealing ring 522 of lower housing 500B. Upper housing 500A and lower housing 500B are then rotated in opposite directions in the plane of the piezo-diaphragm captured therebetween. Such rotation causes tabs 536 of upper housing 500A to slide and lock within interlock slots 530 of lower housing 500B. Housings 500A and 500B are designed such that this interlock operation applies the necessary sealing pressure and mechanical coupling of the annular seal region 30 to the piezo-diaphragm.

The above-described two-piece housing assembly defines a simple fluid flow path. However, other fluid flow paths are possible, as would be understood by one of ordinary skill in the art. For example, recessed portion 524 on the topside of the housing (as well as any recessed portions on the underside of the housing) can be designed other than as shown. Specifically, portion 524 could be contoured to match the deflected shape of the piezo-diaphragm housed therein. Another variation in design of the housing could include incorporating at least one valve to control fluid flow into/out of the housing assembly. In yet another embodiment, openings could be incorporated into the sealing ring 522 when flapper valves are formed in the annular seal region 30 to control fluid flow between the upper and lower housings.

Regardless of the particular construction thereof, the present invention allows the work-producing piezo-diaphragm to be held in a fixture without strain on the piezo-diaphragm or the fixture. One or more of the devices described herein can be linked in a serial or parallel fashion to increase flow rates or pressures. The devices can be fabricated using thin-film technology thereby making the present invention capable of being installed on circuit boards.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function and step-plus-function clauses are intended to cover the structures or acts described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. An electro-active device for control of fluid movement, comprising:

a ferroelectric material defining a first surface and a second surface opposing said first surface, wherein said first surface and said second surface lie in substantially parallel planes;

a first electrode pattern coupled to a portion of said first surface to define a first side of a piezo-diaphragm;

a second electrode pattern coupled to a portion of said second surface to define a second side of said piezo-diaphragm, wherein said first electrode pattern and said second electrode pattern are configured to introduce an electric field into said ferroelectric material when said first electrode pattern and said second electrode pattern have voltage applied thereto, said electric field originating at a region of said ferroelectric material between said first electrode pattern and said second electrode pattern, said electric field extending radially outward from said region of said ferroelectric material and substantially parallel to said first surface and said second surface, whereby said piezo-diaphragm correspondingly deflects symmetrically about said region in a direction substantially perpendicular to said electric field;

means for coupling said piezo-diaphragm, said means for coupling extending radially outward from said piezo-diaphragm so as to define an annular region that circumferentially surrounds said piezo-diaphragm; and a housing connected to said annular region, said housing defining at least one fluid flow path therethrough, said piezo-diaphragm being disposed in said at least one fluid flow path.

2. An electro-active device as in claim 1 further comprising valve means integrated into said annular region wherein fluid can pass therethrough when said valve means is opened.

3. An electro-active device as in claim 1 wherein said housing includes a stacked arrangement of plates for defining said at least one fluid flow path.

4. An electro-active device as in claim 1 wherein said housing comprises first and second elements sandwiching said piezo-diaphragm and said annular region therebetween, said first and second elements configured to interlock with one another while simultaneously defining a cavity on at least one side of said piezo-diaphragm and forming a seal with said annular region.

5. An electro-active device as in claim 4 wherein said annular region has a circular perimeter, and wherein said first and second elements interlock with one another when rotated with respect to one another in a plane that is substantially parallel to said first surface and said second surface.

6. An electro-active device as in claim 1 wherein said piezo-diaphragm has a general shape selected from the group of shapes consisting of circles, triangles and polygons.

7. An electro-active device as in claim 1 wherein a portion of said housing adjacent at least one of said first side and said second side of said piezo-diaphragm has an interior wall contoured to correspond to the known shape of deflection of said piezo-diaphragm during the presence of said electric field.

8. An electro-active device as in claim 1 wherein said first electrode pattern and said second electrode pattern are mirror images of one another.

9. An electro-active device as in claim 8 wherein each of said first electrode pattern and said second electrode pattern comprises at least two independent electrodes having opposite polarity and arranged in an alternating sequence as they extend radially outward from said region of said ferroelectric material, said alternating sequence being defined with respect to a cross-sectional view of said piezo-diaphragm.

10. An electro-active device as in claim 1 wherein said first electrode pattern and said second electrode pattern are staggered with respect to one another along a direction substantially perpendicular to said substantially parallel planes, and wherein said first electrode pattern is energized with a voltage of a first polarity and said second electrode pattern is energized with a voltage of a second polarity that is opposite that of said first polarity.

11. An electro-active device as in claim 1 further comprising a shaped electrode electrically coupled to a center portion each of said first electrode pattern and said second electrode pattern, wherein each said center portion is aligned with one another to define a common perimeter, wherein voltage applied to said center portion of said first electrode pattern is an opposite polarity with respect to voltage applied to said center portion of said second electrode pattern, and wherein said ferroelectric material aligned with said common perimeter defines said region of said ferroelectric material at which said electric field originates.

12. An electro-active device as in claim 1 wherein said means for coupling comprises a dielectric material encasing said ferroelectric material with said first electrode pattern and said second electrode pattern coupled thereto.

13. An electro-active device as in claim 1 wherein said ferroelectric material comprises a single sheet of ferroelectric material.

14. An electro-active device as in claim 1 wherein said means for coupling comprises: a first piece of dielectric material with said first electrode pattern coupled thereto; and a second piece of dielectric material with said second electrode pattern coupled thereto;

said first piece of dielectric material joined to said second piece of dielectric material beyond the perimeter defined by said piezo-diaphragm to thereby form said annular region.

15. An electro-active device as in claim 1 wherein said ferroelectric material comprises a ceramic piezoelectric material.

16. An electro-active device for control of fluid movement, comprising:

a composite ferroelectric material defining a first surface and a second surface opposing said first surface, wherein said first surface and said second surface lie in substantially parallel planes;

a first electrode pattern coupled to a portion of said first surface to define a first side of a piezo-diaphragm;

a second electrode pattern coupled to a portion of said second surface to define a second side of said piezo-diaphragm, wherein said first electrode pattern and said second electrode pattern are configured to introduce an electric field into said ferroelectric material when said first electrode pattern and said second electrode pattern have voltage applied thereto, said electric field originating at a region of said ferroelectric material between said first electrode pattern and said second electrode pattern, said electric field extending radially outward from said region of said ferroelectric material and substantially parallel to said first surface and said second surface, whereby said piezo-diaphragm correspondingly deflects symmetrically about said region in a direction substantially perpendicular to said electric field;

a dielectric material encasing said piezo-diaphragm and extending radially outward from said piezo-diaphragm so as to define an annular region that circumferentially surrounds said piezo-diaphragm; and a housing connected to said annular region, said housing defining at least one fluid flow path therethrough, said piezo-diaphragm being disposed in said at least one fluid flow path.

17. An electro-active device as in claim 16 further comprising valve means integrated into said annular region wherein fluid can pass therethrough when said valve means is opened.

18. An electro-active device as in claim 16 wherein said housing includes a stacked arrangement of plates for defining said at least one fluid flow path.

19. An electro-active device as in claim 16 wherein said housing comprises first and second elements sandwiching said piezo-diaphragm and said annular region therebetween, said first and second elements configured to interlock with one another while simultaneously defining a cavity on at least one side of said piezo-diaphragm and forming a seal with said annular region.

20. An electro-active device as in claim 19 wherein said annular region has a circular perimeter, and wherein said first and second elements interlock with one another when rotated with respect to one another in a plane that is substantially parallel to said first surface and said second surface.

21. An electro-active device as in claim 16 wherein said piezo-diaphragm has a general shape selected from the group of shapes consisting of circles, triangles and polygons.

22. An electro-active device as in claim 16 wherein a portion of said housing adjacent at least one of said first side and said second side of said piezo-diaphragm has an interior wall contoured to correspond to the known shape of deflection of said piezo-diaphragm during the presence of said electric field.

23. An electro-active device as in claim 16 wherein said first electrode pattern and said second electrode pattern are mirror images of one another.

24. An electro-active device as in claim 23 wherein each of said first electrode pattern and said second electrode pattern comprises at least two independent electrodes having opposite polarity and arranged in an alternating sequence as they extend radially outward from said region of said ferroelectric material, said alternating sequence being defined with respect to a cross-sectional view of said piezo-diaphragm.

25. An electro-active device as in claim 16 wherein said first electrode pattern and said second electrode pattern are staggered with respect to one another along a direction substantially perpendicular to said substantially parallel planes, and wherein said first electrode pattern is energized with a voltage of a first polarity and said second electrode pattern is energized with a voltage of a second polarity that is opposite that of said first polarity.

26. An electro-active device as in claim 16 further comprising a shaped electrode electrically coupled to a center portion each of said first electrode pattern and said second electrode pattern, wherein each said center portion is aligned with one another to define a common perimeter, wherein voltage applied to said center portion of said first electrode pattern is an opposite polarity with respect to voltage applied to said center portion of said second electrode pattern, and wherein said ferroelectric material aligned with said common perimeter defines said region of said ferroelectric material at which said electric field originates.

27. An electro-active device as in claim 16 wherein said ferroelectric material comprises a single sheet of ferroelectric material.

28. An electro-active device as in claim 16 wherein said ferroelectric material comprises a ceramic piezoelectric material.

29. An electro-active device for control of fluid movement, comprising:

a piece of ferroelectric material defining a first surface and a second surface opposing said first surface, wherein said first surface and said second surface lie in substantially parallel planes;

a first piece of a dielectric material larger than said piece of ferroelectric material;

a second piece of a dielectric material larger than said piece of ferroelectric material;

a first electrode pattern coupled to a portion of said first piece of dielectric material;

a second electrode pattern coupled to a portion of said second piece of dielectric material;

said first piece of dielectric material with said first electrode pattern coupled thereto and said second piece of dielectric material with said second electrode pattern coupled thereto sandwiching said piece of ferroelectric material, wherein said first electrode pattern is coupled to said first surface to define a first side of a piezo-diaphragm and said second electrode pattern is coupled to said second surface to define a second side of said piezo-diaphragm, wherein said first electrode pattern is aligned with said second electrode pattern to introduce an electric field into said piece of ferroelectric material when said first electrode pattern and said second electrode pattern have voltage applied thereto, said electric field originating at a region of said ferroelectric material between said first electrode pattern and said second electrode pattern, said electric field extending radially outward from said region of said ferroelectric material and substantially parallel to said first surface and said second surface, whereby said piezo-diaphragm correspondingly deflects symmetrically about said region in a direction substantially perpendicular to said electric field;

said first piece of dielectric material being joined to said second piece of dielectric material beyond and all around the perimeter of said piezo-diaphragm to define an annular region of dielectric material that perimetrically borders said piezo-diaphragm; and a housing connected to said annular region, said housing defining at least one fluid flow path therethrough with said piezo-diaphragm disposed in said at least one fluid flow path.

30. An electro-active device as in claim 29 further comprising valve means integrated into said annular region wherein fluid can pass therethrough when said valve means is opened.

31. An electro-active device as in claim 29 wherein said housing includes a stacked arrangement of plates for defining said at least one fluid flow path.

32. An electro-active device as in claim 29 wherein said housing comprises first and second elements sandwiching said piezo-diaphragm and said annular region therebetween, said first and second elements configured to interlock with one another while simultaneously defining a cavity on at least one side of said piezo-diaphragm and forming a seal with said annular region.

33. An electro-active device as in claim 32 wherein said annular region has a circular perimeter, and wherein said first and second elements interlock with one another when rotated with respect to one another in a plane that is substantially parallel to said first surface and said second surface.

34. An electro-active device as in claim 29 wherein said piezo-diaphragm has a general shape selected from the group of shapes consisting of circles, triangles and polygons.

35. An electro-active device as in claim 29 wherein a portion of said housing adjacent at least one of said first side and said second side of said piezo-diaphragm has an interior wall contoured to correspond to the known shape of deflection of said piezo-diaphragm during the presence of said electric field.

36. An electro-active device as in claim 29 wherein said first electrode pattern and said second electrode pattern are mirror images of one another.

37. An electro-active device as in claim 36 wherein each of said first electrode pattern and said second electrode pattern comprises at least two independent electrodes having opposite polarity and arranged in an alternating sequence as they extend radially outward from said region of said ferroelectric material, said alternating sequence being defined with respect to a cross-sectional view of said piezo-diaphragm.

38. An electro-active device as in claim 29 wherein said first electrode pattern and said second electrode pattern are staggered with respect to one another along a direction substantially perpendicular to said substantially parallel planes, and wherein said first electrode pattern is energized with a voltage of a first polarity and said second electrode pattern is energized with a voltage of a second polarity that is opposite that of said first polarity.

39. An electro-active device as in claim 29 further comprising a shaped electrode electrically coupled to a center portion each of said first electrode pattern and said second electrode pattern, wherein each said center portion is aligned with one another to define a common perimeter, wherein voltage applied to said center portion of said first electrode pattern is an opposite polarity with respect to voltage applied to said center portion of said second electrode pattern, and wherein said ferroelectric material aligned with said common perimeter defines said region of said ferroelectric material at which said electric field originates.

40. An electro-active device as in claim 29 wherein said ferroelectric material comprises a ceramic piezoelectric material.

41. An electro-active device as in claim 29 further comprising an electrically non-conductive adhesive between i) said first piece of dielectric material and said piece of ferroelectric material, ii) said second piece of dielectric material and said piece of ferroelectric material, and iii) portions of said first piece of dielectric material and portions of said second piece of dielectric material that lie beyond the perimeter of said piece of ferroelectric material.

* * * * *